US007178262B2

(12) United States Patent
Staples

(10) Patent No.: US 7,178,262 B2
(45) Date of Patent: Feb. 20, 2007

(54) AIR DRYER SYSTEM AND METHOD EMPLOYING A JET ENGINE

(76) Inventor: Wesley A. Staples, 4095 Silver Lake Dr., Palatka, FL (US) 32177-7978

( * ) Notice: Subject to any disclaimer, the term of this patent is extended or adjusted under 35 U.S.C. 154(b) by 0 days.

(21) Appl. No.: 11/194,488

(22) Filed: Aug. 1, 2005

(65) Prior Publication Data

US 2006/0053653 A1 Mar. 16, 2006

Related U.S. Application Data

(63) Continuation of application No. 10/975,032, filed on Oct. 27, 2004, now Pat. No. 6,944,967.

(60) Provisional application No. 60/514,477, filed on Oct. 27, 2003.

(51) Int. Cl.
*F26B 11/12* (2006.01)

(52) U.S. Cl. ..... 34/183; 159/4.02

(58) Field of Classification Search ..... 34/183, 34/191; 159/4.02

See application file for complete search history.

(56) References Cited

U.S. PATENT DOCUMENTS 3,618,655 A 11/1971 Lockwood
3,853,498 A 12/1974 Bailie
4,226,668 A 10/1980 Ferguson
4,334,366 A 6/1982 Lockwood
4,395,830 A 8/1983 Lockwood
4,701,126 A 10/1987 Gray et al.
4,859,248 A 8/1989 Thaler et al.
5,252,061 A 10/1993 Ozer et al.
5,505,567 A 4/1996 Scott
5,658,142 A 8/1997 Kitchen et al.
5,842,289 A 12/1998 Chandran et al.
6,013,158 A 1/2000 Wootten

FOREIGN PATENT DOCUMENTS

JP 8257599 10/1996

*Primary Examiner*—S. Gravini
(74) *Attorney, Agent, or Firm*—Allen, Dyer, Doppelt, Milbrath & Gilchrist, P.A.

(57) ABSTRACT

An air dryer and process employs a jet engine for producing high quality dried products. A turbofan jet engine in an air-drying system uses both thermal and non-thermal air-drying. The turbofan jet engine is housed within an air distribution chamber for directing exhaust air and bypass air from the jet engine into a product drying tube, where it is dried through a combination of thermal drying from heat content in an engine exhaust, and by the kinetic energy of air flowing past the product traveling through the drying tube, that may include a physical impediment for retarding retard the speed of the product solids flowing in the air stream through the tube.

1 Claim, 12 Drawing Sheets

AIR DRYER SYSTEM AND METHOD EMPLOYING A JET ENGINE

CROSS-REFERENCE TO RELATED APPLICATIONS

This application is a continuation application of U.S. Utility application Ser. No. 10/975,032, filed Oct. 27, 2004, now U.S. Pat. No. 6,944,967 which claims the benefit of U.S. Provisional Application No. 60/514,477, filed Oct. 27, 2003, the disclosures of which are hereby incorporated by reference herein in their entireties, all commonly owned.

FIELD OF THE INVENTION

The present invention generally relates to industrial dryers and in particular to a dryer employing a jet engine as a source of heat and air.

BACKGROUND OF THE INVENTION

Many different types of commercial and production endeavors require that a primary product produced and/or by-products thereof are to be dried at a stage after production process. Drying is generally needed in, for example, food processing, fertilizer production, sludge removal and processing, chip and bark processing, agriculture manure processing, and in the processing of distiller's grain, cotton, soybean hulls, mine tailings, coal fines, pellets and powders employed in nuclear waste water cleaning, and many other applications.

By way of example, equipment and systems used for drying or de-watering have been proposed over the years, and have met with varying degrees of success. Such equipment has taken the form of presses (particularly screw presses), centrifuges, gravity screens, and thermal dryers of varying configurations and energy sources. In many of these types of units, drawbacks have included high purchase and operating costs, low output or throughput levels, a lack of range of drying ability, production of "burned" end product, and emissions control problems. In order for a new equipment design or approach to find some level of acceptability, the equipment should address one or more of the above drawbacks, and provide superior features over existing designs.

Many products, in order to serve their intended purpose, are subjected to thermal drying processes in order to reach the level of dryness necessary for use of the product. Thermal drying is, however, a high cost operation. For cost reasons, many products can only be partially dried by known methods, as the price that such products are able to command does not allow for the cost of thermal drying. In many instances, these partially dried products could have a more beneficial use if the cost of drying were lower.

Many, if not most, refined products are thermally dried. There have been known efforts that attempted to develop a practical non-thermal air-drying system that would provide the necessary commercial production rates, but at a lower cost than that of thermal drying. The possibility exists that the end product would be of a higher quality, as well. It would appear that to date, known efforts have not yielded any truly promising systems or designs.

One object of the present invention is to provide an apparatus and method for achieving a high production rate, with drying comparable to known high-cost thermal drying, at a cost lower than that of known thermal drying equipment.

SUMMARY OF THE INVENTION

In view of the foregoing background, the present invention provides a process for producing a high quality dried product. Objects of the present invention may be achieved by employing a power plant, in the form of a turbofan jet engine, in an air-drying system that may use both thermal and non-thermal air-drying. The power plant may produce large quantities of air and heat, and operate with efficiency and an operating cost that provides a system suitable for use in situations for which existing thermal drying systems are too costly to operate.

One dryer system of the present invention may include a turbofan jet engine housed within an air distribution chamber that directs the exhaust air and bypass air from the jet into a material drying tube arrangement. Material to be dried may be injected into the tube and is carried in the airflow stream, where it is dried through a combination of thermal drying from the heat content in the engine exhaust, and by the kinetic energy of air flowing past the material traveling through the tube arrangement. The tube arrangement may include one or more types of physical impediments designed to retard the speed of the solids flowing in the air stream through the tube and/or to create turbulence in the air stream, so that the material is further dried as the high speed air passes by at a higher relative velocity.

The air distribution chamber may include a material preheating system in the form of a material feed belt and material flipper, wherein the material feed belt is thermally coupled to a jet exhaust air chamber, by sharing a common wall through which heat transfer is achieved, by way of example. For wetter materials that are initially in a mostly flowable form, a heat exchange coil can be employed, with the material being pumped through the coil, and the coil and material moving therethrough heated by the jet exhaust.

The drying tube arrangement may include one or more drying cyclones, which are preferably designed to further impede the flow of material, so as to increase contact with the faster airflow through the tube arrangement. One or more product extraction cyclones may be provided at the terminal end of the drying tube arrangement.

A material feed system embodiment may include a hopper for feeding material downwardly into rotating, spoked feed cylinders, which move the material from a position below the hopper into a path of the drying tube arrangement. At this position, the airflow through the drying tube arrangement draws the material from the cylinders into the drying tubes.

BRIEF DESCRIPTION OF THE DRAWINGS

The above and other aspects of the present invention will be more clearly understood from the ensuing detailed description of he preferred embodiments of the present invention, taken in conjunction with the following drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
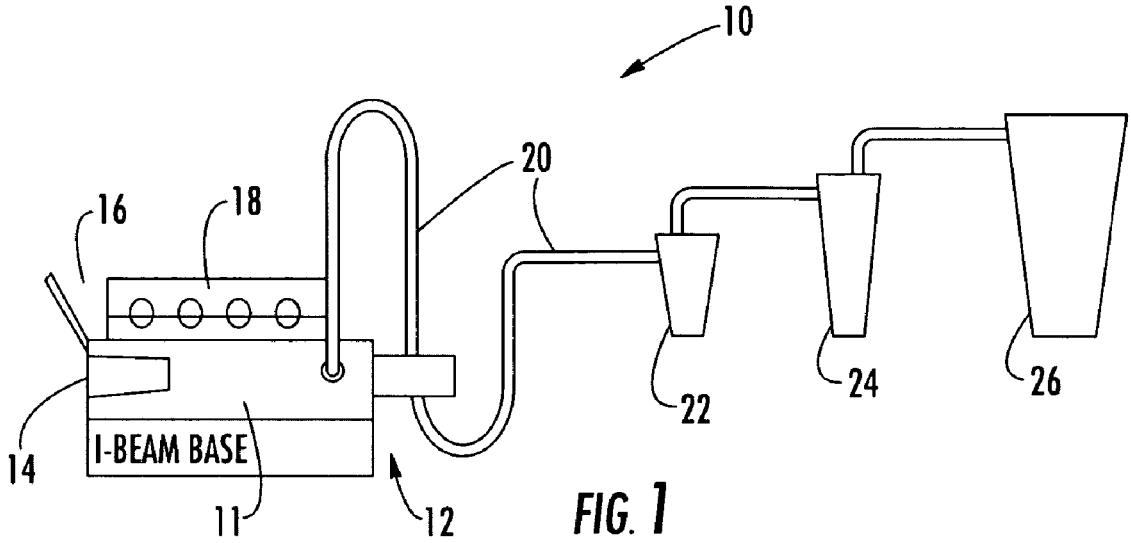
FIG. 1 is a generally schematic side view of the apparatus according to one embodiment of the present invention.

Referring initially to FIG. 1, components an air-dryer apparatus 10 according to the present invention are shown. A housing 12 includes an air distribution chamber 11 is provided at the front end of the apparatus 10. The chamber 11 has mounted therein a jet engine 14, such as a turbofan jet engine, by way of example.

The structure and operating characteristics of turbofan engines are generally known in the art. By way of example, a turbofan engine has a core engine and a bypass duct that directs most of the airflow around the core engine or turbojet, where it is ejected through a cold nozzle surrounding a propelling nozzle at the exit of the core engine. The bypass air is at a lower temperature and a relatively lower velocity, compared with the air exiting the core engine. As is well known in the aviation art, the use of bypass airflow makes the turbofan engine considerably more fuel-efficient than a pure turbojet engine.

The specific operating and performance parameters and characteristics of the turbofan engine to be used in the apparatus of the present invention will likely vary depending upon the size/capacity of each particular drying apparatus that is designed and engineered for a specific drying application. It is anticipated, however, that the design of a given dryer apparatus will be driven in part by selection of commercially available turbofan engines.

With reference again to FIG. 1, the chamber 11 may be on the order of eight (8) feet in height, by 7.5 feet in width, by about twenty-four (24) feet in length. The chamber 11 illustrated in FIG. 1 has a hopper 16 and a preheating unit 18 disposed at an upper surface of the housing 12. The preheating unit 18 is coupled to housing 12 such that heat generated by the turbofan engine 14 is transferred to the material to be dried, thereby elevating the temperature of the material and bringing the water or other liquids contained in the material to be dried closer to an evaporation point.

FIG. 1 also illustrates a drying tube assembly 20 into which the material to be dried is introduced. As discussed in greater detail later, the drying tube may include protrusions or other obstacles to slow the speed of the material to be dried relative to the air flow velocity of the jet air. Also shown in FIG. 1 are two drying cyclones 22, 24, in which the solid material is further slowed by protrusions disposed on the inside of the cyclone wall. The solid material may also be broken up by the protrusions. The material and airflow are carried through the two drying cyclones 22, 24 to a separating cyclone 26 which separates the material from the air flow, and removes the material as a finished product from the lower portion of the cyclone 26. The length or amount of drying tube to be employed, as well as the number and size of the drying cyclones to be used (if any), will be determined as the equipment design and layout is undertaken for each particular application in which the apparatus is to be used.

Figure 2:
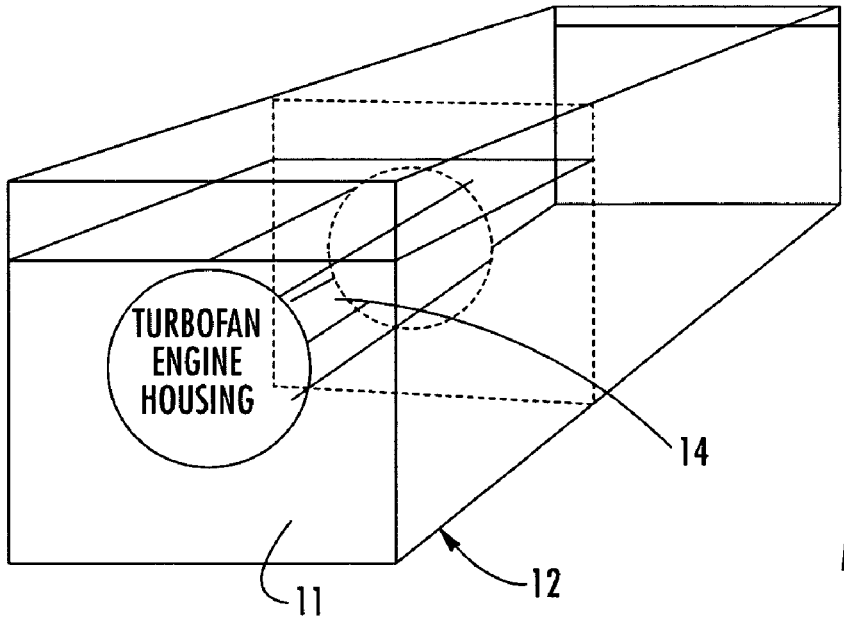
FIG. 2 is a generally schematic view of the housing for the power plant according to an embodiment of the present invention.

The schematic view of chamber 11 in FIG. 2 is provided to show one general positioning of the turbofan jet engine 14 in that chamber. The jet engine 14 may be mounted in an appropriate manner at one end of the chamber 11, with the engine having its air intake at the outer periphery of the chamber. It is envisioned that, in one preferred embodiment, all or a portion of the intake air to the engine will be air that is recovered from the product separating cyclone at the terminal end of the process, and is treated prior to returning it to the inlet of the jet.

With reference to FIGS. 1, 2, 3 and FIGS. 4A and 4B, it can be seen that the air distribution chamber 11, handles the high temperature, high velocity jet exhaust air, the jet engine bypass air, and an ambient air flow. The jet exhaust air may preferably be passed through a transfer pipe 30 into a hot air duct 32, and passed upwardly into heating chamber 34. Heating chamber 34 will transfer heat to and through an upper wall 36 of the heating chamber 34. The engine exhaust air will then flow out of heating chamber 34 through 35, into an air mixing chamber 38, where the hot air is mixed with the engine bypass air, as well as, optionally, ambient air drawn into chamber 12 through one or more openings in the walls thereof. The vents can be controlled (i.e., opened or closed) as desired to regulate the pressure in heating chamber 34, as desired or as may be required. In the construction illustrated in FIGS. 1–4, the mixed air then passes through exit openings 40 (FIGS. 4A, 4B) disposed along each lateral wall 42, 44 of chamber 11, and into drying tube 20 (FIG. 1), that is connected to each of the exit openings 40.

Figure 3:
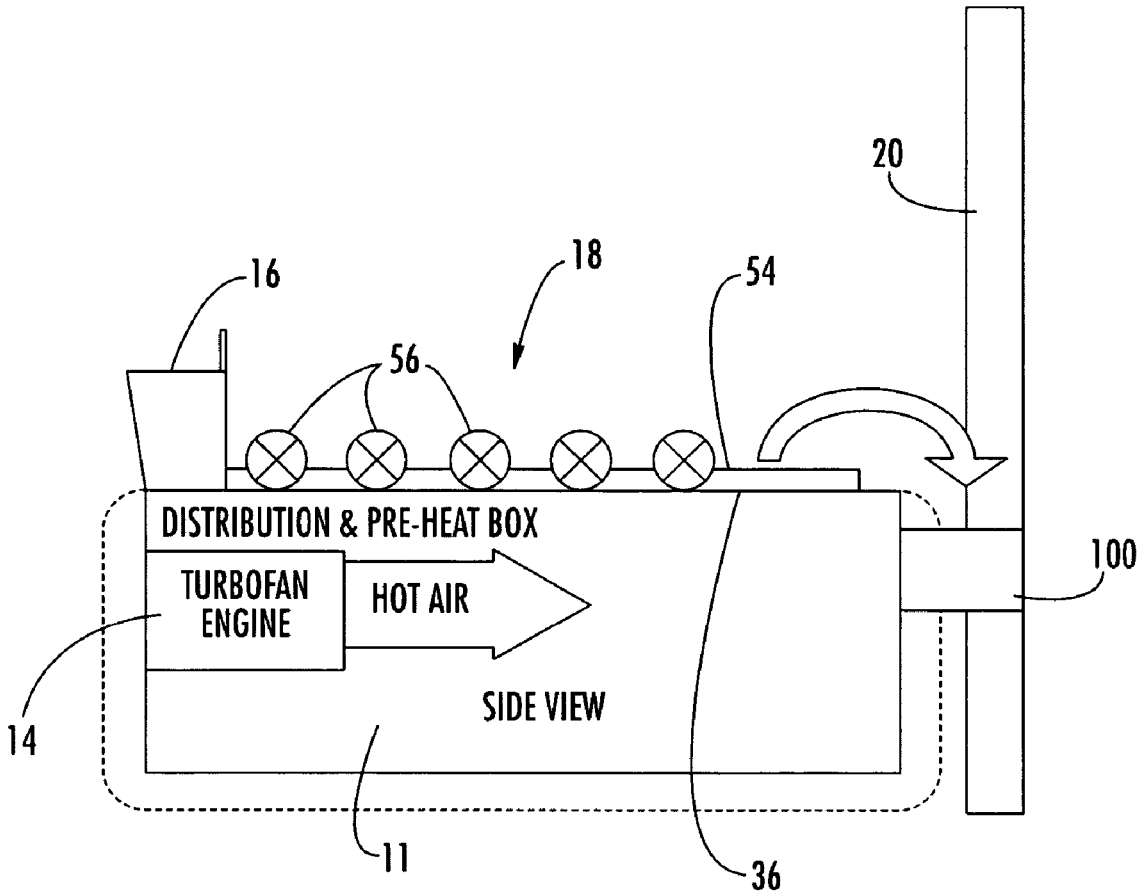
FIG. 3 is a substantially schematic side view of the housing and feed system.
Figure 4A:
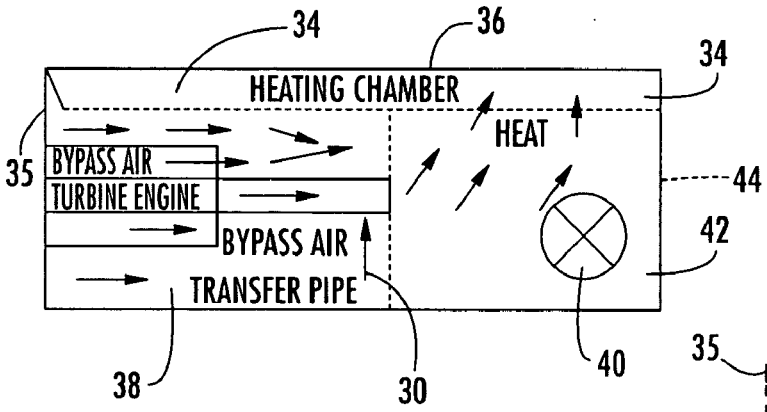
FIG. 4A and FIG. 4B are schematic views illustrating airflow through a housing in accordance with an embodiment of the present invention.
Figure 4B:
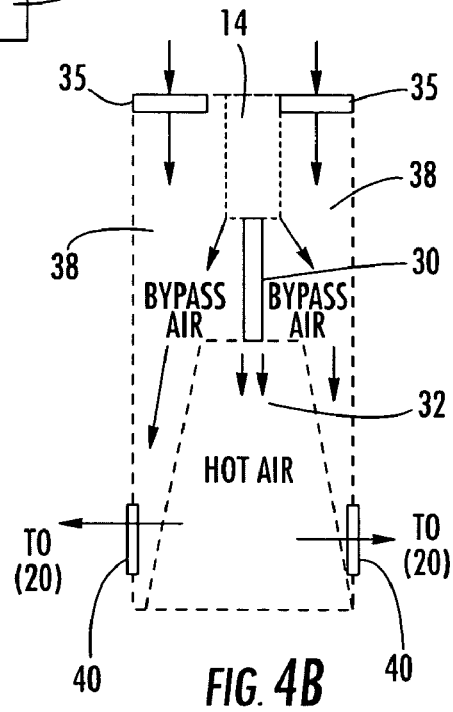

FIG. 3 illustrates a preheating system 18, having a wet material hopper or bin 16, a feed belt 54, made of stainless steel, by way of example, in consideration of the temperatures that will be experienced, and a series of material flippers 56. In this embodiment, wet material is fed to bin or hopper 16, and may be deposited therefrom onto feed belt 54. Feed belt 54 runs along upper wall 36 of heating chamber 34, and is either in contact with, or is spaced closely apart from, the wall 36. As the feed belt 54 advances the material, the material flippers rotate to lift and flip the material on the belt, so that different surfaces of the material are exposed to the heat emanating from heating chamber 34.

Once the material reaches the end of the belt, it has been pre-heated and/or dried to a desired extent, and the material is deposited into a material injection box 100, which operates to introduce the material into the airflow of the drying tube 20, in a manner that will be discussed in greater detail later herein.

Figure 5:
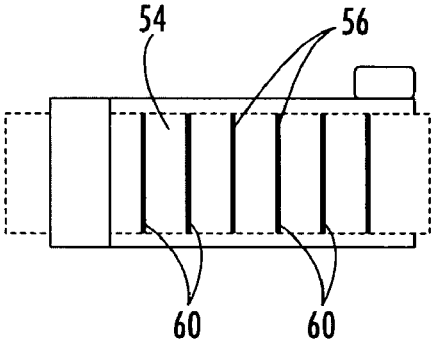
FIG. 5 is a schematic top view of a preheating and/or pre-drying subassembly in accordance with an embodiment of the present invention.
Figure 7:
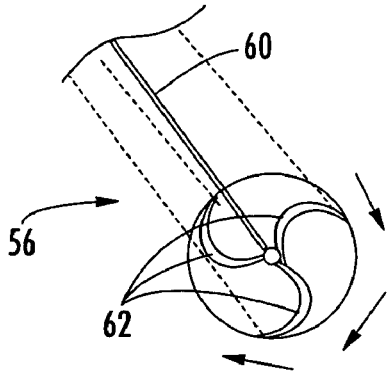
FIG. 7 is a perspective line drawing of the material flipper used in the FIG. 5 subassembly.
Figure 6:
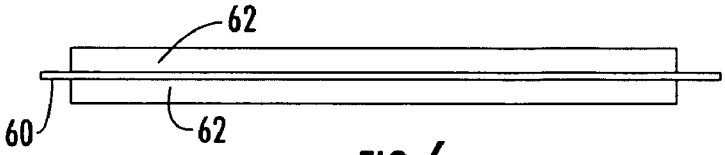
FIG. 6 is a side elevation view of a material flipper used in the FIG. 5 subassembly.

FIGS. 5–7 illustrate in greater detail the construction of the preheating/predrying subassembly. Feed belt 54 may be driven by a motor and gearbox, illustrated schematically at 58 in FIG. 5. The wet material bin or hopper 16 is disposed above the belt at its forward end. Each of shafts 60 is intended to show the position of the center shaft of a plurality of material flippers 56. As seen in FIGS. 6 and 7, the material flippers have a central shaft 60 and a plurality (three shown) of arcuate flipping blades 62 extending along a majority of the length of central shaft 60. The length of the blades will preferably be determined to correlate to approximately the width of feed belt 54. The central shafts 60 of the material flippers will be rotated by gearing, belt, or other drive coupling means, and will preferably be driven by either motor/gearbox 58 or by an independent motor or drive means. The material flippers 56 may be rotated in a direction counter to the feed direction of the belt such that the blades operate to scoop and lift material from the feed belt, and deposit the material substantially on a side which was not previously in contact with the feed belt. The number of, and spacing between, the material flippers will preferably be determined based upon the particular requirements and features of a given dryer unit.

Consideration should generally be given to the length of time which the material should stay in contact with the belt to be heated and dried, and how many times a flipping or agitation to expose other portions of the material to the heat will affect the desired drying results.

Figure 8:
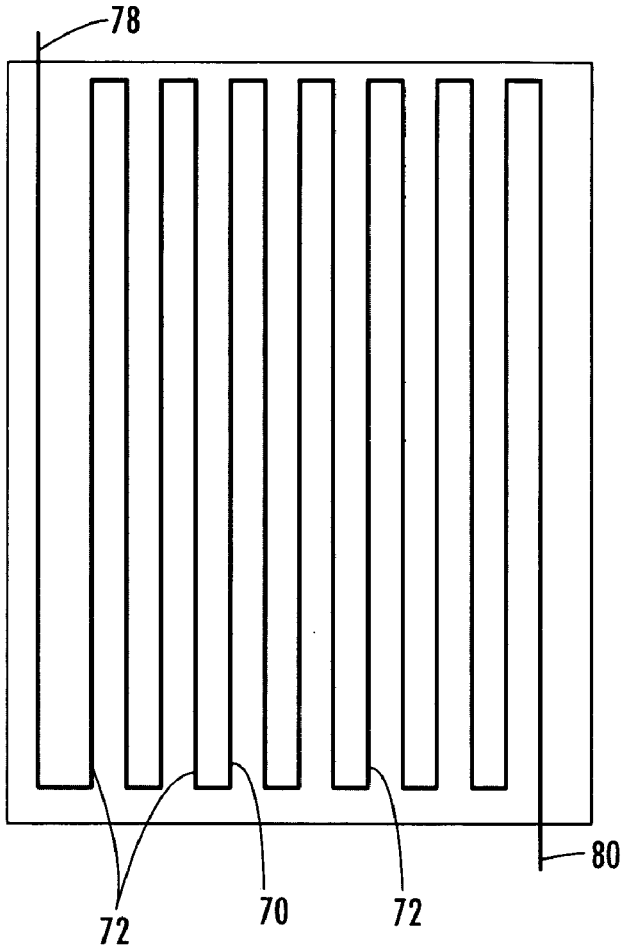
FIG. 8 is a schematic top plan view of an alternative embodiment of a preheating and/or pre-drying subassembly.
Figure 9:
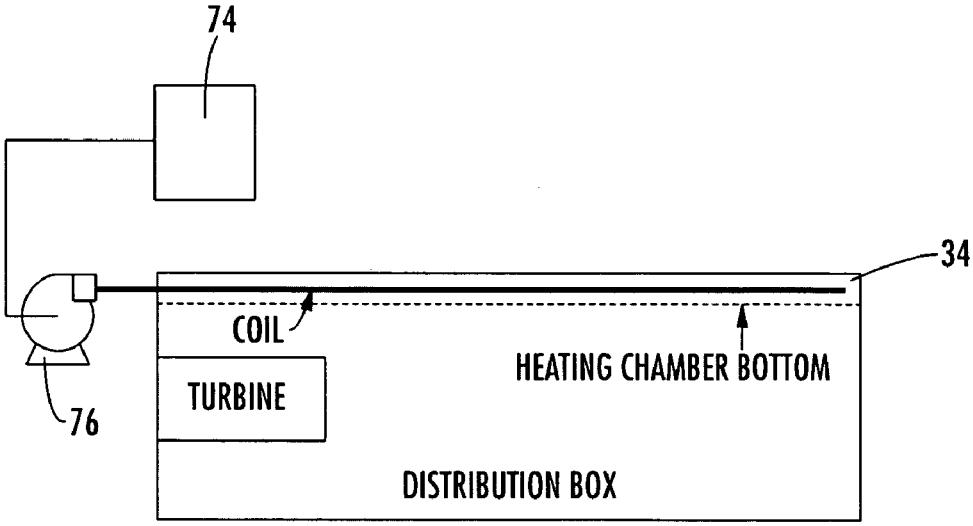
FIG. 9 is a schematic side view of the housing/chamber incorporating the FIG. 8 preheating and/or pre-drying subassembly.

FIGS. 8 and 9 illustrate an alternative preheat design that takes advantage of a large thermal capacity of the jet engine exhaust. In the place of a feed belt 54, a tubing or pipe construction, that will herein be termed a coil 70, is provided in the heating chamber 34. The coil 70 may preferably comprise multiple straight runs of pipe or tubing 72 connected at alternate ends in a serpentine-type manner, through which wet material may be passed to be preheated and/or partially dried.

It is envisioned that a coil may be used in place of the feed belt preheat subsystem particularly where the drying apparatus is designed to process wetter materials, such as those having an initial liquids content of greater than about 50%, or even higher. The high liquid-content (or low solids content) material may preferably be pumped from a holding tank 74 through the coil by a positive displacement pump 76 having a variable drive, of a type known to those of ordinary skill in the art. Where the preheating coil subassembly is employed with materials expected to exhibit higher viscosities, it is envisioned that other material delivery equipment of an injection type, such as a concrete pump, may be employed.

The coil may be mounted in the heating chamber 34 from the bottom, or may alternatively be suspended from the top of the chamber. FIG. 8 illustrates the tubing 72 running essentially parallel to the longitudinal direction of chamber 11, with the inlet 78 disposed at one end, and the outlet 80 at the other. Variations to this, such as other positioning of the inlet and outlet, and tubing orientation (e.g., extending transverse to the longitudinal direction of the chamber), are seen as being design choices available to persons of ordinary skill in the art, and within the scope of the invention herein.

The material passing through the coil 70 is heated, such that the liquid may partially evaporate and become a separate phase from the wet solids material. It is also envisioned that the material emanating from the outlet could be introduced into a large volume, low pressure area or chamber, where the heated liquid would be permitted to "flash" off as a separate vapor phase, leaving the material considerably drier as it is introduced into the main dryer.

If it is desired to provide an air-dryer apparatus that could be used to process both high liquids content materials and higher solids content materials, both the coil subassembly within the heating chamber and the feed belt subassembly atop the heating chamber may be provided. Selection of which preheat system to use may then be made based upon the properties of the material being introduced.

Figure 12:
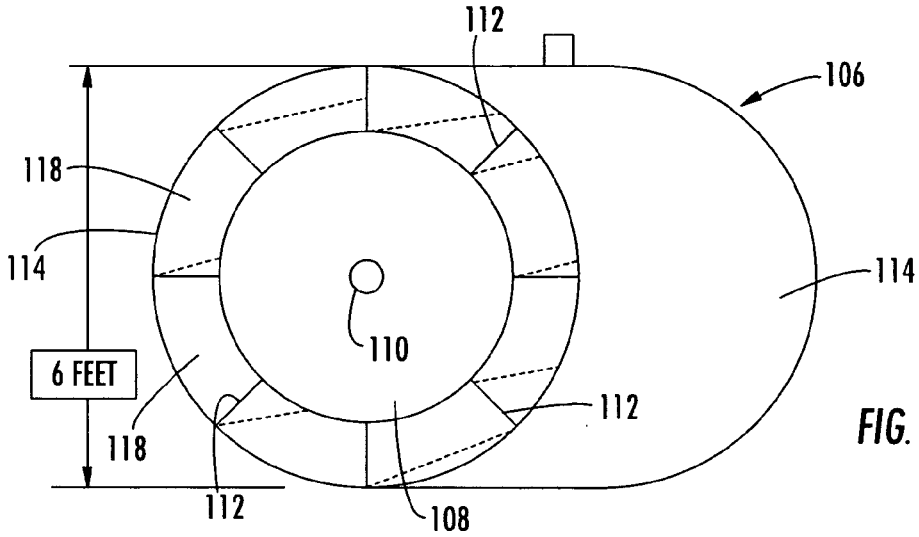
FIG. 12 is a perspective view of a feeder cylinder for use in the FIG. 10 material injector subassembly.
Figure 11:
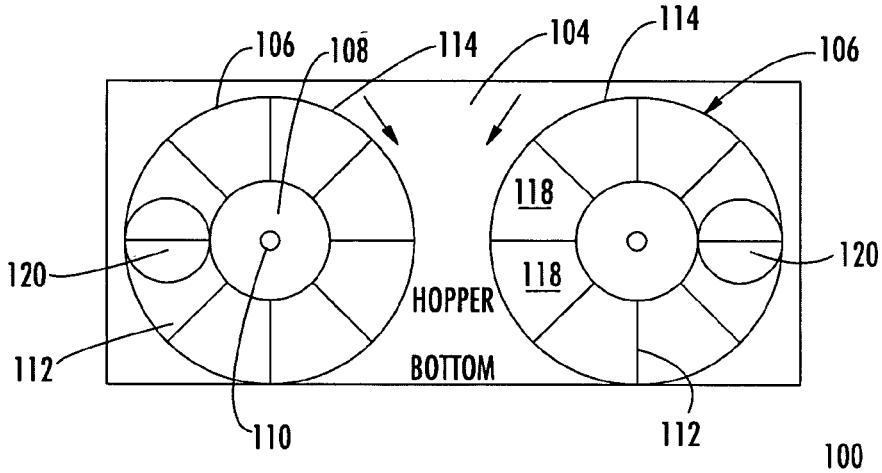
FIG. 11 is a schematic top plan view of the FIG. 10 material injector subassembly.
Figure 10:
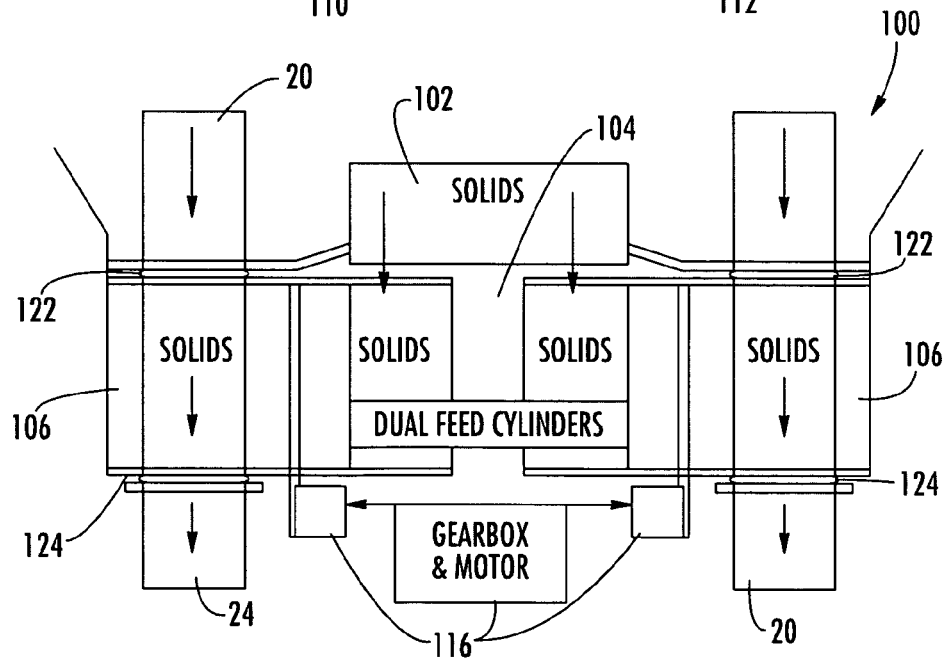
FIG. 10 is a schematic side elevation view of a material injector subassembly in accordance with an embodiment of the present invention
Figure 13:
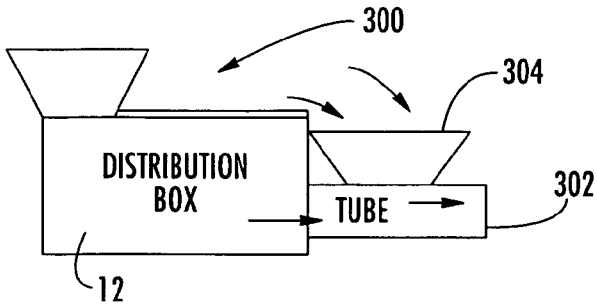
FIG. 13 is a schematic side view of an alternative embodiment of a material injector subassembly.
Figure 14:
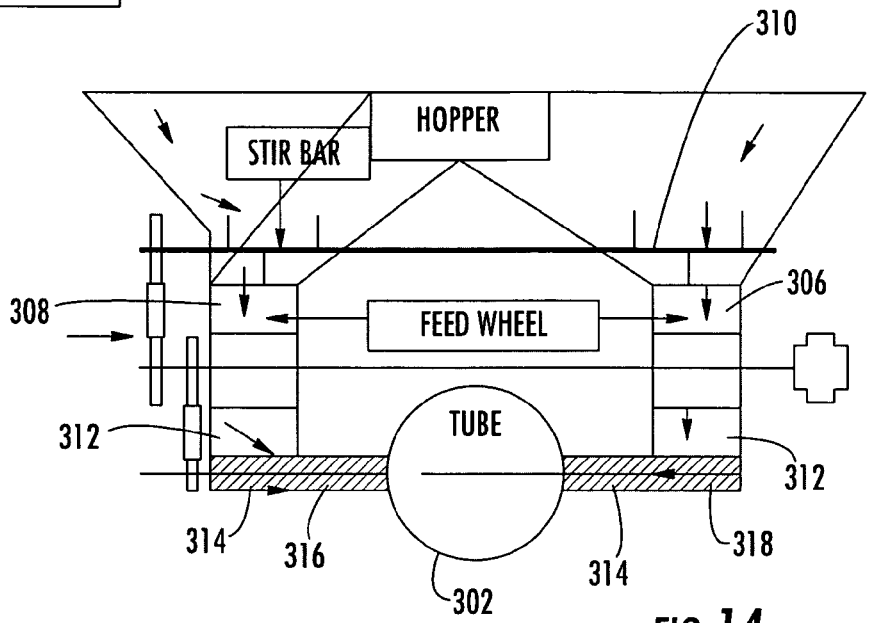
FIG. 14 is a schematic cross-sectional view of the FIG. 13 material injector subassembly.

FIGS. 10, 11 and 12 illustrate one preferred embodiment of a material injector subassembly 100, used to introduce a mushy material (either preheated/predried or not) into the main drying tube assembly 20. This drying tube system, as illustrated, includes two sets of tubing 24, 26, which run along essentially identical paths (or mirror image paths), or, alternatively are joined together into a single tubing run at a desired point downstream of the material injector subassembly 100. If smaller drying capacities or throughput are desired, the system may be designed to have only one tubing run, and a single injector in the injector subassembly. Alternatively, the system may be designed to run at half-capacity, wherein the material is fed to only one half of the material injector subassembly 100.

Illustrated with reference to FIG. 3, the material injector subassembly 100 may be located at an exit end of the feed belt subassembly, or at the exit to the preheating coil subassembly, when this equipment is present in place of feed belt 54. FIG. 10 illustrates schematically that the solids material is fed from the preheater subassembly 102 into injector hopper 104. Operating within hopper 104 are a pair of feeder cylinders 106.

Feeder cylinders include a drum core 108 affixed to a drive shaft 110. Extending radially outwardly from drum core 108 are a plurality of spokes 112, and, attached at an outer periphery of the spokes is an outer cylinder wall 114.

As illustrated with reference to FIG. 10, the feeder cylinders 106 are coupled to a gearbox and motor assembly 116, which operates to rotate the feeder cylinders 106 inside of hopper 104. The material to be dried is deposited into hopper 104, at a central portion thereof. The material may substantially fill each sector 118 formed by the spokes 112 extending between the drum core 108 and the outer cylinder wall 114, as each sector rotates through the central portion of the hopper. The sectors 118 carry the material from the central portion of the hopper to a position at the outer portion of the hopper which is in alignment with, and open to, the two sets of tubing 24, 26 of the drying tube assembly 20.

As the sectors rotate into alignment with openings 120 in the hopper 104, which openings are in alignment with and sealed to tubing sections, the material will, by force of the airstream flowing through tubing 24, 26, and/or gravity, exit out of the hopper and into the drying tube assembly 20. As will be recognized from viewing FIG. 11 in particular, the material will be fed substantially continuously into the drying tube 20, as the spokes are continuously advancing new material toward the openings 120.

It will be recognized that this material injector equipment may be sized and operated for various feed rates or capacities, as an ordinary exercise in engineering. In a system, for example, in which drying tubing 24, 26 has a 24" diameter, the feeder cylinders 106 may preferably be six (6) feet in outer diameter, the drum core may be two (2) feet in diameter, thus resulting in the spokes 112 being 24 inches in length, correlating to the 24-inch diameter of tubing (see FIG. 11). With the material injector equipment so sized, and with the feeder cylinders 106 rotating at a speed of one (1) revolution every eight (8) minutes, the equipment is capable of delivering about 20 tons of material per hour into the drying tube assembly 20.

With reference again to FIG. 10, at the upper and lower portions of hopper 104, appropriate seals 122, 124 are provided that abut the upper and lower surfaces of the feeder cylinders 106, so as to contain the material deposited in sectors 118 as the feeder cylinders turn. By way of example, the seals 122, 124, may preferably be made of Delrin®, which will also serve to lubricate the regions of contact between the cylinders and seals. Other materials may be employed, as will be recognized by persons of ordinary skill in the art.

An alternative preferred material injector subassembly 300 is illustrated in FIGS. 13–16. In this embodiment, the housing 12 for turbofan engine 14 has a single, substantially horizontally oriented, tube 302 that is coupled to the drying tube assembly described earlier with reference to FIG. 1. A hopper 304 is positioned to receive material from a preheat section, such as the feed belt system illustrated in FIG. 3. Hopper 304 has one or more, and preferably two feed wheels 306, 308 at a lower extent thereof. Material advances downwardly through hopper 304, and is optionally agitated by a stirring bar 310, and then enters sectors 312 of the vertically oriented rotating feed wheels 306, 308. It will be recognized, in viewing especially FIGS. 14 and 15, that feed wheels 306, 308, have spokes extending radially from a central core, but are open at the periphery to receive the material therein. Thus, the construction may be similar to that of feeder cylinders 106, but without using outer cylinder wall.

Figure 15:
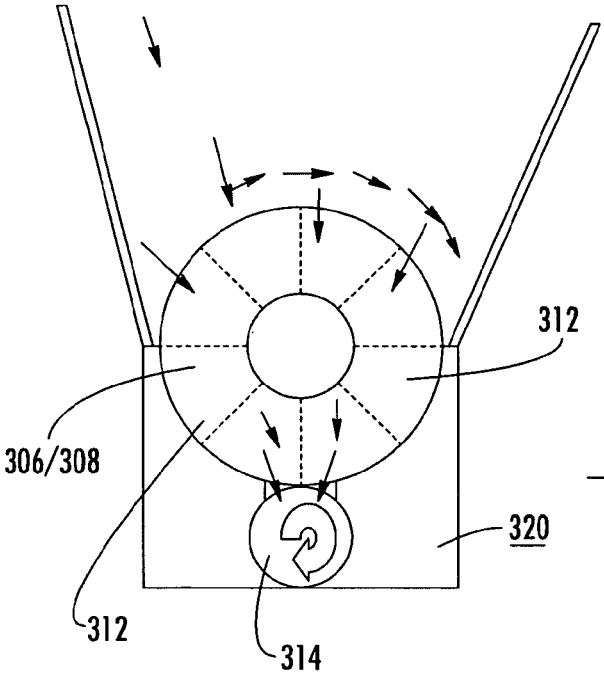
FIG. 15 is a schematic side elevation view of a feed wheel and auger suitable for use with the FIG. 13 material injector subassembly.

Feed wheels 306, 308 rotate around a horizontal axis, and deliver material to an auger 314 having blades 316, 318 canted to advance the material inwardly into tube 302, and into the airstream exiting housing 12. FIG. 15 illustrates that feed wheels 306, 308, and auger 314 may be mounted in a structure 320 that serves as an air lock, which prevents the air flowing through tube 302 from exiting out through the material injector subassembly 300.

Figure 16:
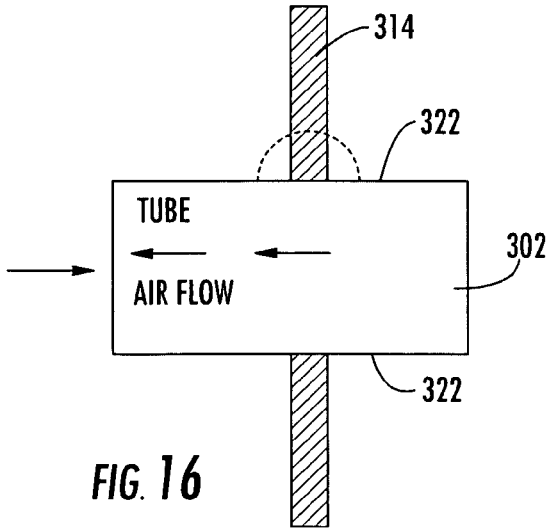
FIG. 16 is a schematic top plan view of the auger of the FIG. 13 material injector subassembly, coupled to a tube carrying drying air therethrough.

After material is dumped out of each successive sector 312 of the rotating feed wheels into auger 314, auger rotates to advance the material inwardly toward tube 302. As can be seen in FIG. 16, tube 302 may be provided with a vane or vanes 322, or other flow restrictor, to provide a venturi effect at the area where auger empties into tube 302. The vanes may be disposed only at the area immediately upstream of the auger entry openings, or may be provided around the entire inner diameter of the tube 302 in this region.

Figure 17:
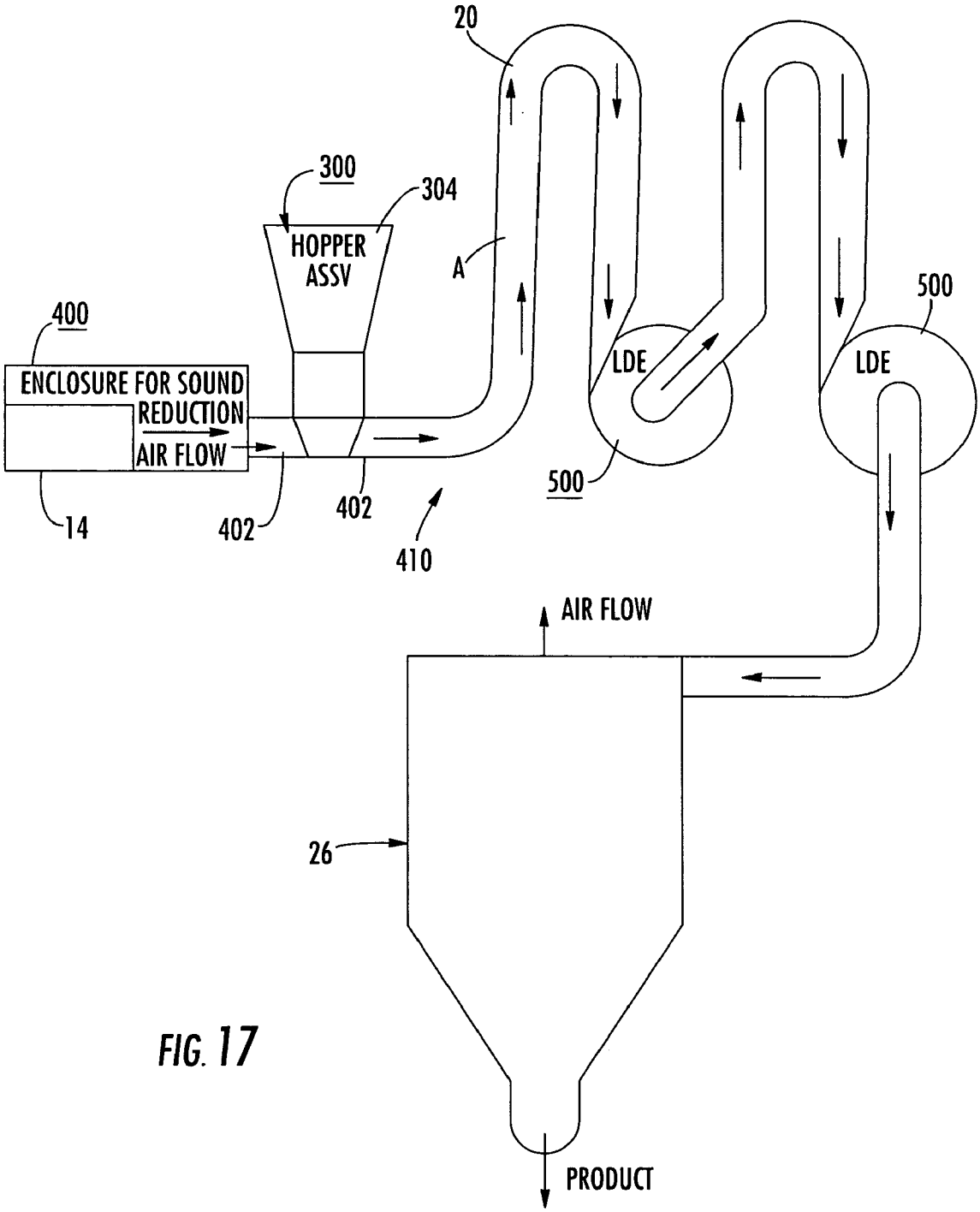
FIG. 17 is a schematic side elevation view of an alternative preferred embodiment of a drying apparatus in accordance with teachings of the present invention.
Figure 18A:
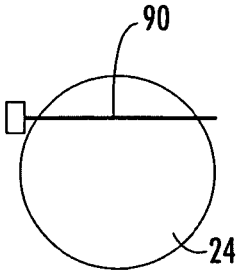
FIGS. 18A–D are schematic cross-sectional views of a drying tube assembly employed in an embodiment of the present invention.
Figure 18B:
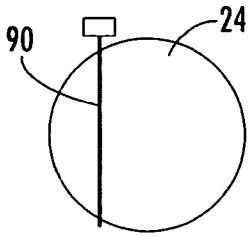
Figure 18C:
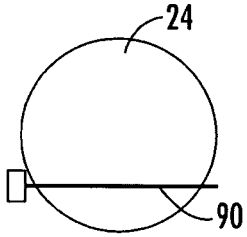
Figure 18D:
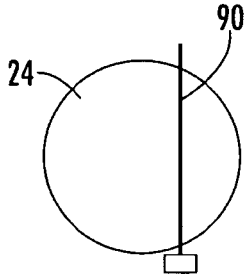
Figure 19A:
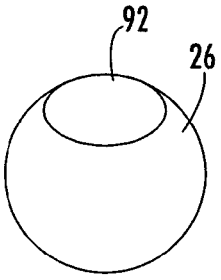
FIGS. 19A–E are schematic cross-sectional views of a drying tube assembly employed in an alternative embodiment of the present invention.
Figure 19B:
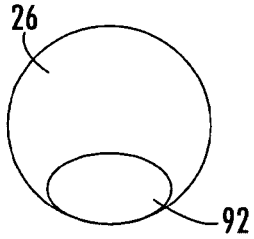
Figure 19C:
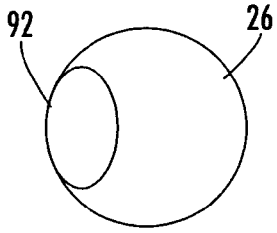
Figure 19D:
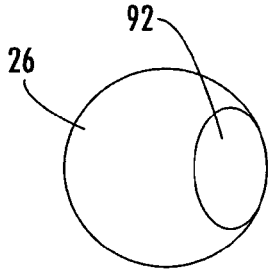
Figure 19E:
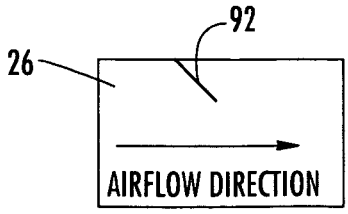

FIG. 17 illustrates an alternative preferred variation on the unit illustrated in FIGS. 13–16. In this embodiment, no preheater subassembly is provided, in that there are some potential applications for this apparatus which will not require a preheating stage. In this embodiment, the housing 400 will not generally serve as an air distribution box, and is provided principally for noise reduction, with appropriate sound insulation. Engine exhaust air and engine bypass air, as well as any ambient bypass air brought into housing 400, are joined and sent directly into tube 402, which is coupled to a drying assembly 410.

In this embodiment, one preferred material injector subassembly may be the subassembly 300 described and illustrated with reference to FIGS. 13–16. Material will enter tube 402 from an auger 314, (FIG. 14), and the material will become entrained in the airstream exiting housing 400, and conveyed to the drying tube assembly. Material may be fed to the hopper 304 by a material conveyor or any other suitable means, by way of example.

By way of example, the above-described material injector subassemblies may be used where the material to be dried is either a mushy solid, a pretreated material that contains on the order of 35% solids, or superhydrated materials. Other feed systems, such as positive displacement pumps with variable drives may be used where the material is more fluid. Further, for higher viscosity materials, an injection system such as a concrete pump may be used.

By way of further example, once the material enters the drying tube assembly 20, an objective in obtaining the maximum of a desired level of drying in the system is to maintain the air flow at as high a rate as the system will permit, while slowing down the material traveling through the drying tube assembly to a maximum extent possible, without causing clogging. This will permit both the thermal energy and the kinetic energy of the flowing air stream to operate to dry the material to a desired level.

One approach may involve simply using vertical tubing runs with an upward airflow, as would be the case in tubing section A in FIGS. 1 and 17. The material resists becoming fully entrained in the upward airflow through tubes 24, 26, due to gravitational forces acting on the material. This approach is believed to be especially suitable for use when the material is at its wettest or heaviest condition, such as at a point shortly after being initially introduced into the drying tube assembly 20.

Another approach may involve the use of physical obstructions within the drying tubing runs. FIGS. 18A–D, 19A–E, and 20A, B, illustrate some preferred examples as to how this approach could be implemented.

FIGS. 18A–D represent, schematically, cross-sections of a drying tube (24 or 26) at successive positions along the length of the tube. A plurality of rods 90, made of steel or other material, may be positioned to protrude across a portion of the cross-sectional area inside the tube. The rods would preferably be positioned to be perpendicular to the flow direction, and, as seen in the successive views, may be rotated by 90° at each successive position, i.e., horizontal upper, vertical left, horizontal lower, vertical right, within the tube (as shown in FIGS. 18A–D). Such a pattern may be repeated at several locations along the length of the tube.

The rods are positioned to impede the progress of solid materials passing thereby, by physically interfering with the passage of the material. It can be seen in viewing all of FIGS. 18A–D collectively that a central area of the tube may have no rods or other physical impediments such that the airflow may continue substantially unimpeded while various portions of the material will collide with the rods 90 as the material is advanced by the airstream. The rods may, alternatively, be positioned at angles, orientations, and positions that are not illustrated, as desired.

FIGS. 19A–E illustrate an alternative embodiment in which material flow is impeded by placement of physical obstacles. A plurality of flaps 92 are provided. The flaps 92 may be constructed of steel or other material, and may be secured to an inner wall of the tube by weldment or other suitable fastening means. Flaps 92 may individually occupy approximately 25% of the cross-sectional area of the tube, or any lesser or greater percentage, as desired. The flaps 92 may preferably be canted or inclined in the direction of airflow through the tube (see FIG. 19E), such that the material impinging against each flap 92 will be allowed to slide free of the flap after being slowed by the collision with the flap. The positioning of the flaps 92 may be successively at different orientations relative to the previous flap. Thus, moving in the direction of airflow proceeding from FIG. 19A to FIG. 19D, the flaps may be positioned (in the orientation illustrated), in a top portion of the tube, a bottom portion, a left portion, and a right portion. Alternatively, the 90° rotation scheme used with rods 90 in FIGS. 18A–D could be employed. While the flaps 92 are shown as being somewhat fan-shaped or rounded, the shape is not seen as being critical to the proper operation of the flaps, and other shapes may perform equally as well.

Figure 20A:
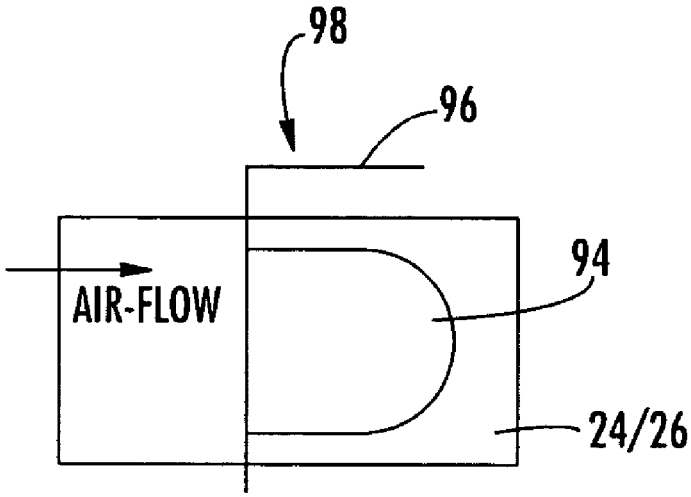
FIGS. 20A, B are schematic cross-sectional views of a drying tube assembly according to an alternative embodiment of the present invention.
Figure 20B:
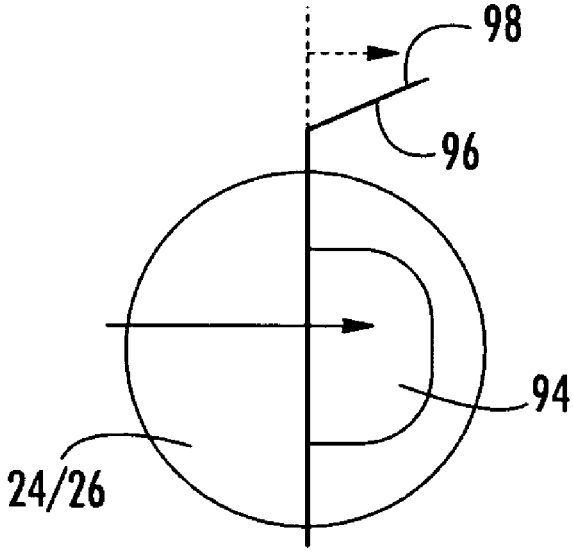

By way of example, FIGS. 20A, B, illustrate yet an additional embodiment of a physical impediment to material flow. This embodiment employs a diverter flap 94 that is preferably mounted along a centerline of the cross-section of the tube, and is mounted by control arm 96 so as to be pivotable within the tube. As can best be seen in the cross-sectional view of FIG. 20B, the diverter flap 94 may be pivoted or rotated into varying positions to impede the flow of solid material (principally), to varying degrees. It is envisioned that a handle 98 extending from control arm 46 will be moved cyclically by an automated program and control means (not shown), such as solenoids and timers, to provide intermittent and varying degrees of blockage to one side of the tube, and then the other side of the tube. The handle 98 and diverter flap 94 are preferably positioned to lie in the same plane, such that the position of the handle at the exterior of the tube is representative of the position of the diverter flap 94 inside the tube.

Figure 21:
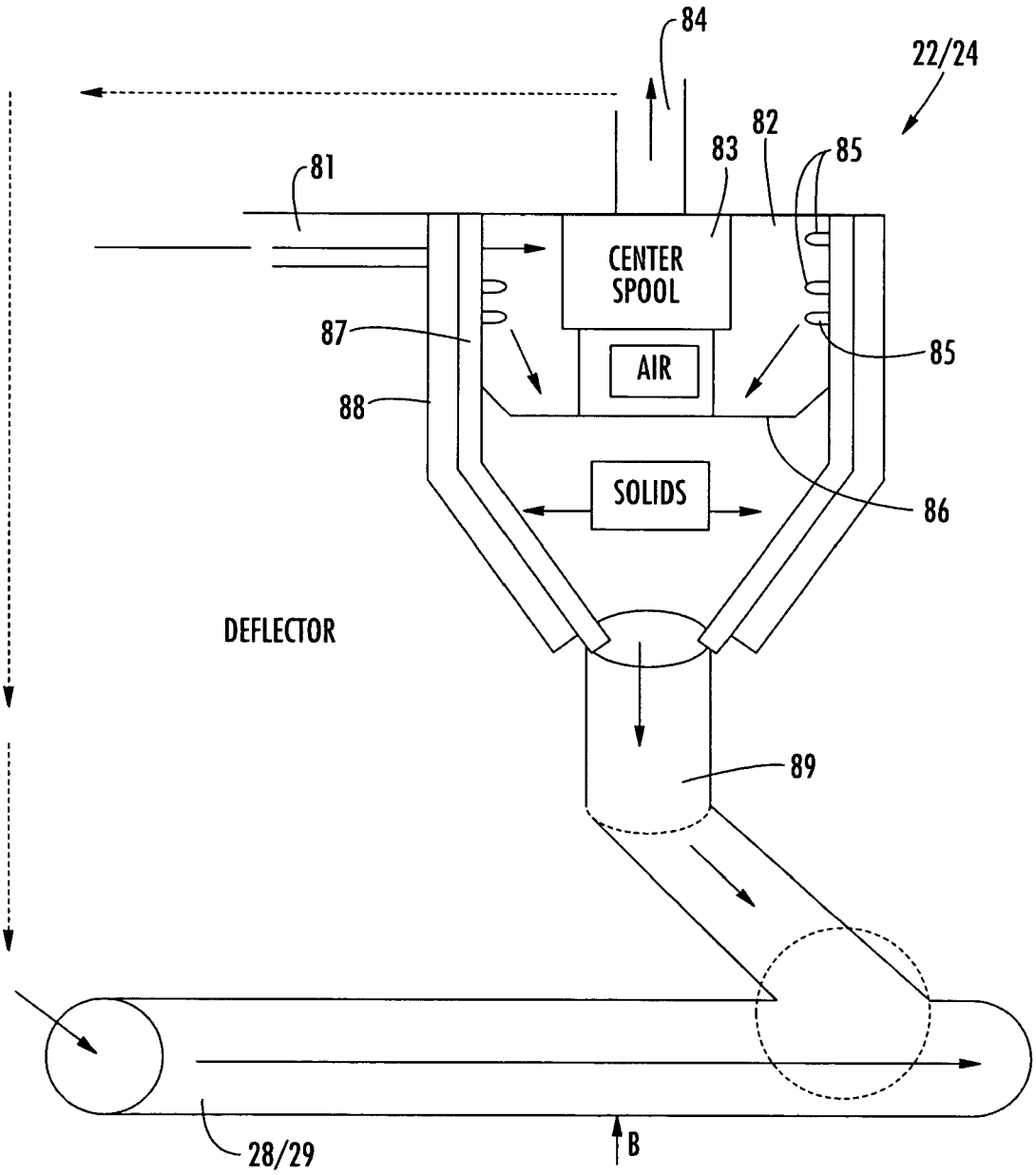
FIG. 21 is a schematic cross-sectional view of a drying cyclone which may be employed in accordance with one embodiment of the present invention.

With reference again to the schematic illustration of the system in FIG. 1, drying cyclones 22, 24, may be employed as a further means of retarding material flow while permitting the airflow to remain at higher rates. FIG. 21 is a schematic cross sectional illustration of one embodiment of such a cyclone 22, 24. The airflow with entrained material enters the cyclone, preferably tangentially, through inlet 81. The material spins in a circular motion in an upper portion 82 of the cyclone, while a center spool 83 collects a majority of the airflow, and conveys the air through air line 84 to a continuation of drying tubing 28, 29.

The upper portion 82 may have hardened teeth 85 protruding from the walls to slow and breakup the solid material while moving toward the bottom of the cyclone. A deflector assembly 86 extending underneath center spool 83 and extending outwardly to the walls of the upper portion 82 of the cyclone may be provided to aid in controlling air and material flow.

The walls 87 of cyclone 22, 24 may be heated to enhance the drying/evaporation of the material coming into contact with the walls. Heating elements 88 may preferably be hot air chambers into which heated air from the airflow stream is passed, or any other type of heating element that will not significantly detract from the energy efficiency of the overall system.

As the material slows and falls to the lower portion of the cyclone, it exits through cyclone outlet 89. Cyclone outlet 89 is coupled to the continuation of drying tubing 28, 29, and deposits the material into the air flow in the tubing. In one preferred embodiment, the region in which the material reenters the airflow stream is configured such that a venturi effect can be achieved in tube 28, 29 as the material is introduced, or immediately upstream thereof. It is envisioned that it may be necessary to introduce additional, or makeup, air prior to the entry point where the material rejoins the airstream, as indicated by arrow B. The continuation of tube 28, 29, will convey the material further downstream, to either a second drying cyclone, or through additional drying subassemblies, or to the final material separating cyclone 26.

The size of the drying cyclone will likely vary for each dryer apparatus that is designed and engineered for different applications. The cyclone or cyclones are employed, as noted, to increase the differential in speed between the main air flow and the material to be dried, and the size, including internal diameter and length, may be varied as a matter of routine engineering to achieve the desired effect.

Figure 22:
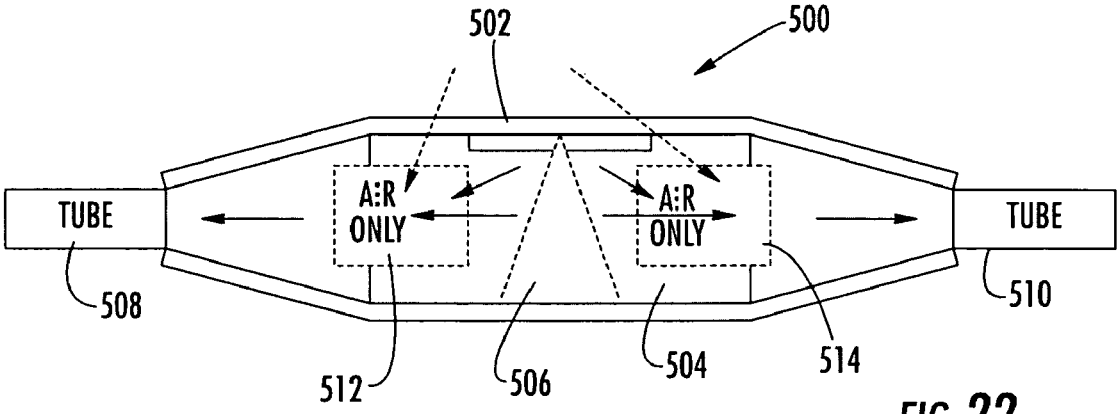
FIG. 22 is a schematic cross-sectional view of a lateral drying elevator in accordance with a preferred embodiment of the present invention.
Figure 23:
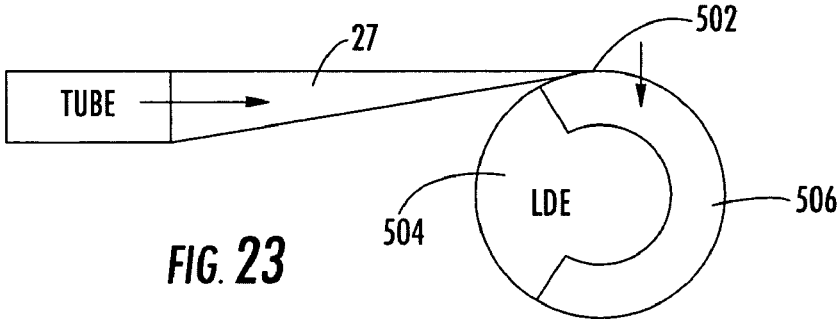
FIG. 23 is a schematic side sectional view of one lateral drying elevator.
Figure 24:
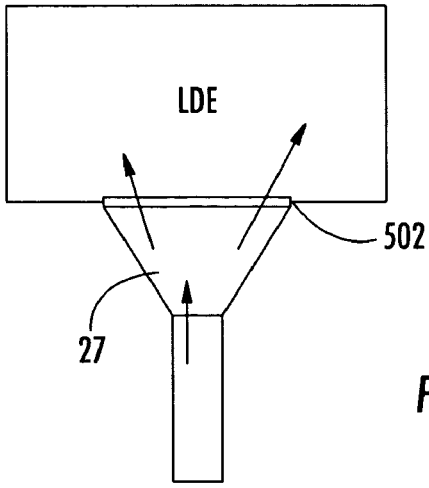
FIG. 24 is a schematic top plan view of the lateral drying elevator and a flared inlet section of tubing.

With reference now to FIGS. 22–24 a lateral drying element (LDE) 500 may advantageously be used in the dryer apparatus of the present invention. The LDE 500 has an inlet 502 into a generally cylindrical chamber 504.

As can best be seen in FIGS. 23 and 24, the inlet is coupled to tube 28 or 29 by a flared section of tubing 27, which flattens the cross-section through which the air and material must flow. The air and material are introduced into chamber 504 substantially tangentially to the chamber.

A wedge-shaped flow splitter 506 is provided at substantially the center of the longitudinal extent of chamber 504. Flow splitter 506 extends along the wall of chamber 504 from a point substantially adjacent inlet 502, and around approximately one-half to two-thirds of the inner periphery of chamber 504.

The inlet and flow splitter will operate to divide the incoming air flow and material into two approximately equal flow streams, and the air and solid material will travel around the interior of the LDE several times before being advanced to outlet tubes 508, 510. As shown schematically in FIG. 22, the outlet tubes are recombined downstream into a continuation of tube 28 or 30.

Internal tubes 512, 514 may optionally be suspended at the central area in chamber 504, which will operate to more directly and more quickly direct principally an air flow of the incoming air and material toward the outlet tubes. One or more LDEs 500 may be positioned in the run of tubing 28, 29, either in place of, or in addition to the one or more drying cyclones. The LDE 500 increases the dwell time or retention time of the air and material in the dryer. One potential advantage of an LDE as compared with, for example, a drying cyclone, is that the unit may be oriented in any number of ways, as it is not ultimately wholly dependent on gravity to operate effectively.

Figure 25:
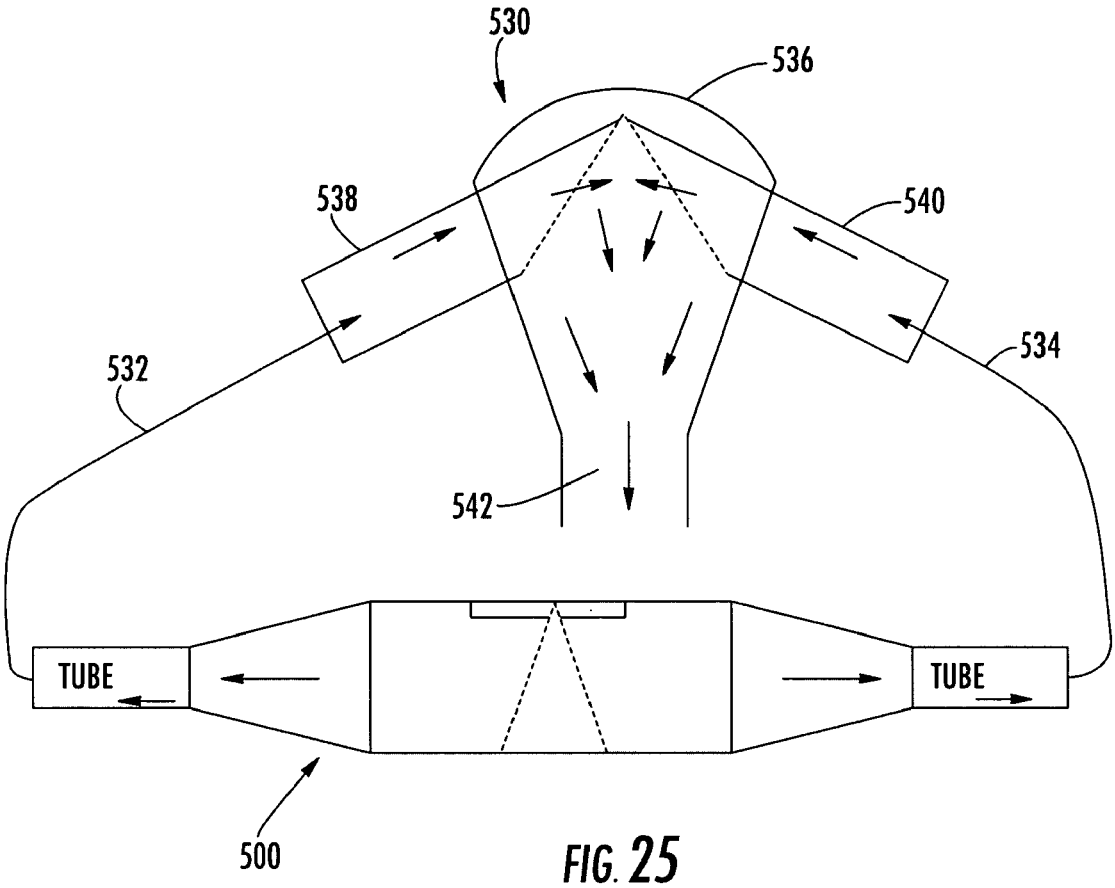
FIG. 25 is a schematic view of a particle collider in accordance with an embodiment of the present invention.

With reference to FIG. 25, a chamber 530 may be used in the air dryer apparatus of the present invention. This solids particle collision chamber 530 may preferably be used in tandem with an LDE 500, in that the material leaving the LDE is preferably split into two material streams, shown schematically at 532, 534.

One collision chamber 530 may include a housing 536 and two inlet pipes 538, 540. The inlet pipes 538, 540 are positioned to direct the two material streams 532, 534, toward one another, so that the solid particles will collide into one another. With the speed of the particles expected to be on the order of 400 mph, and thus having a high momentum, the collisions induced will cause the particles to break up. This results in a reduction of the average particle size of the solid material, which in turn increases the exposed surface area of the solids material. The increased surface area will enhance the ability of the flowing air stream to dry the material.

After the opposing material streams collide in housing 536, these streams may preferably be united into a single stream flowing through outlet 542. Outlet 542 will be coupled to the dryer tube system 20, and the air stream and material carried therein will continue to a further component in the air dryer apparatus 10.

Many modifications and other embodiments of the invention will come to the mind of one skilled in the art having the benefit of the teachings presented in the foregoing descriptions and the associated drawings.

Therefore, it is understood that the invention is not to be limited to the specific embodiments disclosed, and that modifications and embodiments are intended to be included within the scope of the appended claims.

That which is claimed is:

1. An apparatus comprising:

a housing having a chamber therein;

a jet engine carried within the chamber;

a hopper operable with the chamber at a first end thereof;

a drying tube operable with the chamber at a second end thereof;

a drying cyclone operable with the drying tube; and a separating cyclone operable with the drying cyclone.

* * * * *